United States Patent [19]

Gaisser

[11] Patent Number: 4,987,928

[45] Date of Patent: Jan. 29, 1991

[54] DOUP HEDDLE WITH MAGNETIC COUPLING PART

[75] Inventor: Rudi Gaisser, Reutlingen, Fed. Rep. of Germany

[73] Assignee: C. C. Egelhaaf GmbH & Co. Maschinenfabrik KG, Reutlingen, Fed. Rep. of Germany

[21] Appl. No.: 403,146

[22] Filed: Sep. 1, 1989

[30] Foreign Application Priority Data

Sep. 5, 1988 [DE] Fed. Rep. of Germany ..... 3830107

[51] Int. Cl.[5] ..... D03C 7/00

[52] U.S. Cl. ..... 139/52

[58] Field of Search ..... 139/50, 51, 52

[56] References Cited

U.S. PATENT DOCUMENTS

| | | | |
|---|---|---|---|
| 1,037,151 | 8/1912 | Kaufmann | 139/52 |
| 3,058,495 | 10/1962 | Kaufmann | 139/51 |
| 4,572,241 | 2/1986 | Kramer | 139/52 |

FOREIGN PATENT DOCUMENTS 8703920 9/1988 Fed. Rep. of Germany .

*Primary Examiner*—Andrew M. Falik

*Attorney, Agent, or Firm*—Michael J. Striker

[57] ABSTRACT

A twisting device for power looms comprises oppositely moving heddle supporting rails, two lifting heddles arranged on the heddle supporting rails for standing threads, a semi-heddle for turning threads controlled separately from the heddle supporting rails. It also has a coupling part having magnetic properties and arranged so that the semi-heddle is supported through the coupling part on both the lifting heddles in a longitudinally displaceable manner, and two countercoupling parts having magnetic property and alternatingly cooperating with the coupling part. One of the countercoupling parts is movable together with one of the heddle supporting rails while the other of the countercoupling parts is movable together with the other one of the heddle supporting parts.

14 Claims, 2 Drawing Sheets

DOUP HEDDLE WITH MAGNETIC COUPLING PART

BACKGROUND OF THE INVENTION

The present invention relates to a twisting device for power looms. More particularly it relates to such twisting device which has two oppositely moving heddle supporting rails, lifting heddles for standing (stationary) threads arranged on the heddle supporting rails, and a semi-heddle for turning (moving) threads which is separately controlled from the heddle supporting rails by a magnetic coupling.

The driving of the semi-heddle by the lifting heddles must be actuated by sufficiently strong permanent magnets. For this purpose a semi-shaft for the semi-heddle is provided with a sliding piece having magnets and guided on separate bars which are connected with the heddle supporting rails as disclosed for example in German patent document GM No. 8703920.6. This coupling is relatively expensive in its construction and also space-consuming so that it has not been introduced to market.

SUMMARY OF THE INVENTION

Accordingly, it is an object of the present invention to provide a twisting device of the above mentioned general type which avoids the disadvantages of the prior art.

More particularly, it is an object of the present invention to provide a twisting device in which the semi-heddle is controlled by a magnetic coupling and formed in a simple and space-saving manner without affecting the operational safety.

In keeping with these objects and with others which will become apparent hereinafter, one feature of the present invention resides, briefly stated, in a twisting device of the above mentioned type in which the semi-heddle is supported through a magnetic or magnetizable coupling part on both lifting heddles, it alternatingly cooperates with two magnetizable magnetic countercoupling parts, and one of the coupling parts is movable together with one of the heddle supporting rails, while the other of the coupling parts is movable together with the heddle supporting rail.

When the twisting device is designed in accordance with the present invention, special guiding parts are dispensed with. The semi-heddle is guided directly on the lifting heddles. The coupling part operating for guiding the semi-heddle can advantageously be formed as a sliding body which surrounds at both sides the lifting heddles and is opened and then is closeable upon placing on the lifting heddles.

In accordance with another advantageous feature of the present invention, the sliding body can be composed to two parts which after placing on both lifting heddles is fixedly connected with one another. The connection can be made by riveting or clamping.

The countercoupling parts can be connected with the lifting heddles, and on the other hand they can be connected with the heddles by special holders which are mountable on the heddle supporting rails, for example, releasably in a clamping manner.

The twisting device formed in accordance with the present invention can be formed of a lower number of preferably exchangeable parts in an economical manner, it is less massive, and can be arranged in loom shafts with lower space consumption.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
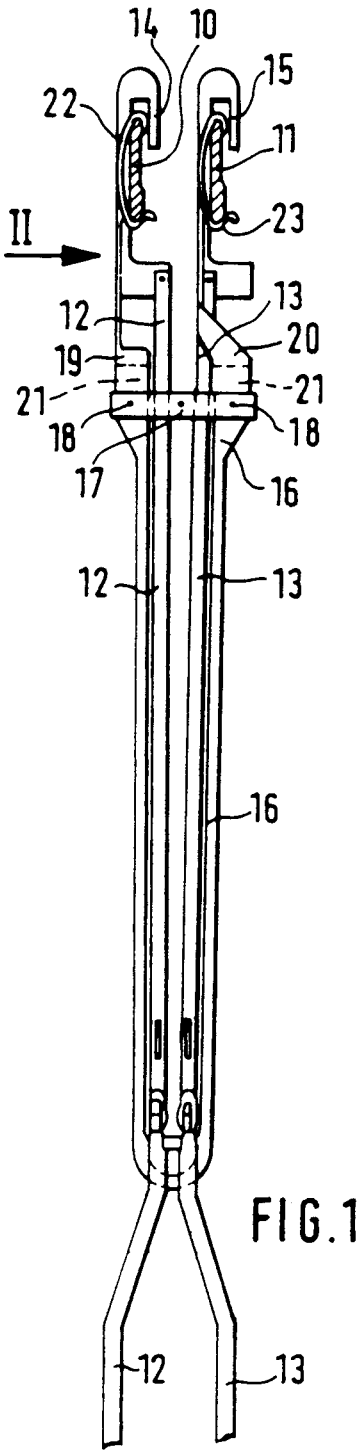
FIG. 1 is a partial view of two lifting heddles arranged on two different heddle supporting rails, and a semi-heddle of a twisting device in accordance with the first embodiment of the present invention.

The drawing shows lifting loom shafts only partially, and more particularly only two heddle supporting rails 10 and 11 are shown in section. The lifting heddles 12 and 13 shown only over portion of their lengths and provided with their upper end eyes 14 and 15 are anchored on the heddle supporting rails 10 and 11. A semi-heddle 16 has a known U-shape. It is supported at both ends of its U-legs directly and longitudinally displaceably on both lifting heddles 12 and 13 by means of a bridge-shaped coupling part 17. The coupling part 17 surrounds the lifting heddles 12 and 13 at both sides and can be composed for example of two parts. After placing of the coupling part 17 on both lifting heddles 12 and 13, the above mentioned two parts are fixedly connected with one another by a rivet 18 and also with both legs of the semi-heddle 16.

Figure 2:
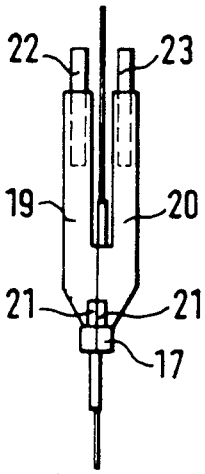
FIG. 2 is a partial view of a coupling part and a countercoupling part of the twisting device as seen in direction of the arrow II in FIG. 1.
Figure 3:
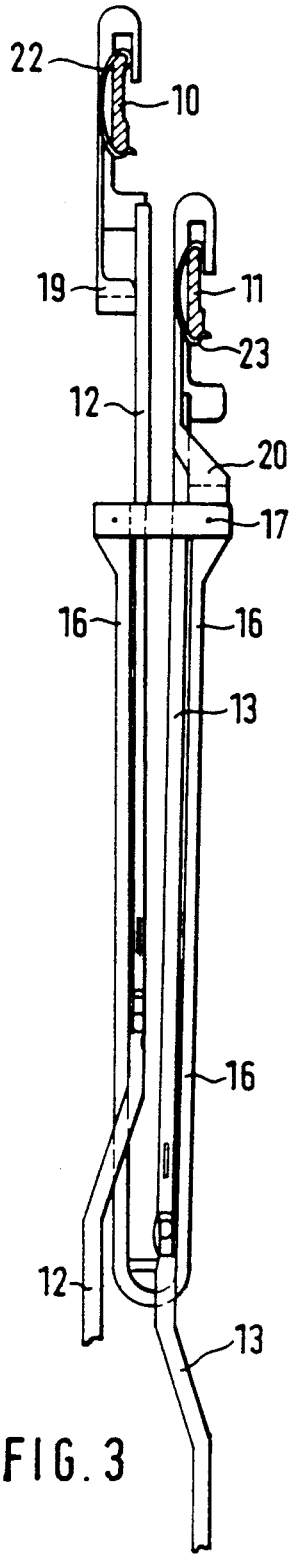
FIG. 3 is a front view of FIG. 1 with two oppositely offset heddle supporting rails and thereby offset lifting heddles.

In the embodiments shown in FIGS. 1–3, the whole coupling part is composed of a steel which is suitable to serve as a magnetic armature material. The coupling part 17 can, however, be produced also from synthetic plastic material in which the magnetic armature is formed.

The coupling part 17 formed as a magnetic armature cooperates with two countercoupling parts 19 and 20. The countercoupling parts are composed of synthetic plastic material, and a permanent magnet body 21 is respectively formed in them. One countercoupling part 19 is anchored through a spring clip holder 22 near the end eye 14 of the lifting heddle 12 on the heddle supporting rail 10. The other countercoupling part 20 is releasably and exchangeably mounted by a spring clip holder 23 near the end eye 15 of the lifting heddle 13 on the heddle supporting rail 11.

During opposite reciprocating movements of both heddle supporting rails 10 and 11, the lifting heddles 12 and 13 as well as the countercoupling parts 19 and 20 are taken along in movement. During a downward movement of the heddle supporting rail 11 to the position shown in FIG. 3, also the semi-heddle 16 is moved downwardly through the countercoupling part 20 which is anchored on the heddle supporting rail 11 and abuts against the bridge-shaped coupling part 17. During the subsequent upward movement of the heddle supporting rail 11, the semi-heddle 16 is taken along again upwardly through the magnetic coupling between the parts 17 and 20, until the simultaneously downwardly moving countercoupling part 19 reaches the coupling part 17 and therefore is forcedly separated from the countercoupling part 20, and the coupling part 17 with the semi-heddle 16 is again taken along downwardly. During each of these movements, the coupling part 17 slides on one of both lifting heddles 12 or 13. By a special shaping of the lifting heddles, the semi-heddle 16 which guides a turning (moving) thread is controlled in a desired manner so that different relative positions of the turning thread relative to a standing (stationary) thread guided in the lifting heddles 12 and 13 are achieved.

Figure 4:
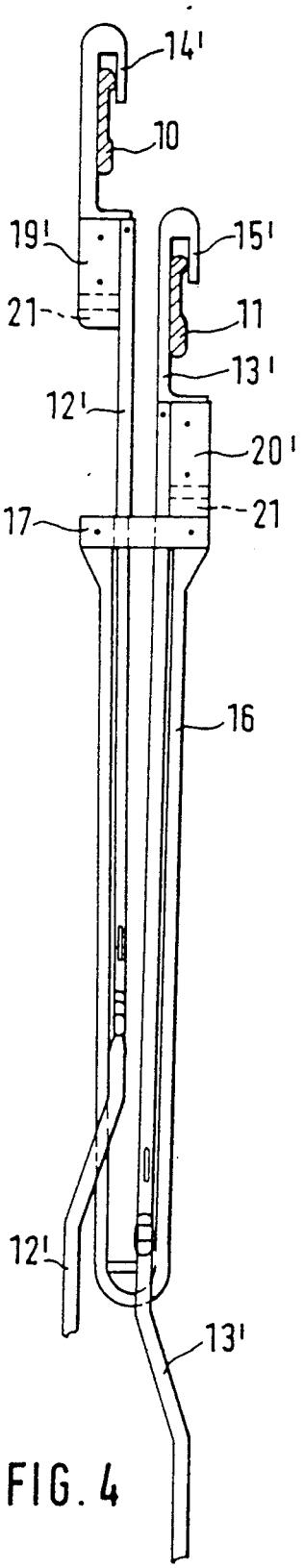
FIG. 4 is a view substantially corresponding to the view of FIG. 3, but showing a second embodiment of the turning device of the present invention.

FIG. 4 shows a different embodiment of the rotary device which differs from the rotary device of the embodiment of FIGS. 1–3 in that its countercoupling parts 19' and 20' in the region of upper end eyes 14' and 15' are connected respectively fixedly with on of the lifting heddles 12' or 13'. Also, both countercoupling parts 19' and 20' are provided with inserted permanent magnets 21 which cooperate with the bridge-like coupling part 17 of the semi-heddle 16 formed as a magnetic armature, in the above described manner.

Figure 6:
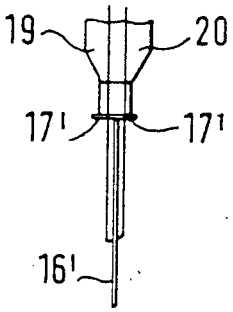
FIG. 6 is a partial view of a coupling region of the semi-heddle in direction of the arrow VI in FIG. 5.
Figure 5:
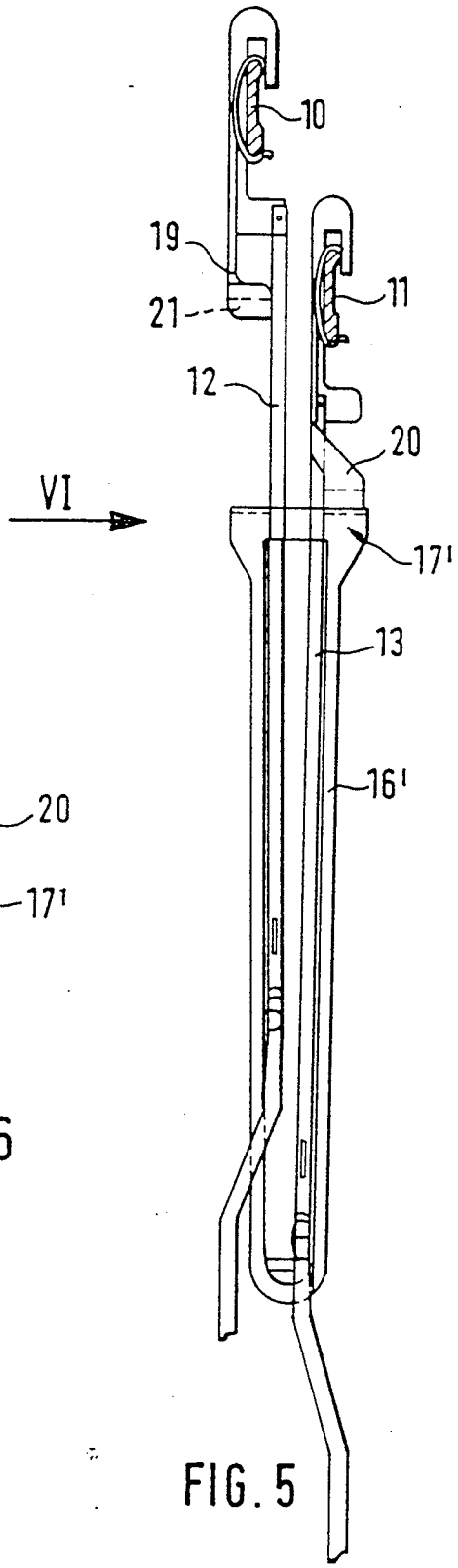
FIG. 5 is a view substantially corresponding to the views of FIGS. 3 and 4, but showing a third embodiment of the twisting device according to the present invention.

FIGS. 5 and 6 show an example of another embodiment, which differs from the embodiment of FIGS. 1–3 in that a semi-heddle 16' with a coupling part 17' acting as a magnetic armature is formed as a one-piece punched part. No special coupling part is here provided. Instead the coupling part 17' for guiding the semi-heddle 16 on the lifting heddles 12 and 13 and acting as a magnetic armature for the permanent magnet 21 arranged in the countercoupling parts 19 and 20, is formed by a respective cutout and a bending of parts of the ends of both U-legs of the semi-heddle 16'. Its profile is shown in FIG. 6.

It is to be understood that the coupling parts 17, 17' and the countercoupling part 19, 20; 19', 20' can also have a different shape deviating from the shown shapes. Also, the permanent magnet or magnets can be arranged in the coupling part 17, and the countercoupling part 19, 20; 19', 20' can form a magnet armature.

It will be understood that each of the elements described above, or two or more together, may also find a useful application in other types of constructions differing from the types described above.

While the invention has been illustrated and described as embodied in a turning device for power looms, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A twisting device for power looms, comprising oppositely moving heddle supporting rails; two lifting heddles arranged on said heddle supporting rails for standing threads; a semi-heddle for turning threads controlled separately from said heddle supporting rails; a coupling part having magnetic properties and arranged so that said semi-heddle is supported through said coupling part on both said lifting heddles in a longitudinally displaceable manner; two countercoupling parts having magnetic property and alternatingly cooperating with said coupling part, one of said countercoupling parts being movable together with one of said heddle supporting rails while the other of said countercoupling parts being movable together with the other one of said heddle supporting rails.

2. A twisting device as defined in claim 1, wherein said coupling parts and said countercoupling parts are composed of a magnetic material.

3. A twisting device as defined in claim 1, wherein said coupling parts and said countercoupling parts are composed of a magnetizable material.

4. A twisting device as defined in claim 1, wherein said countercoupling parts are connected with said lifting heddles respectively.

5. A twisting device as defined in claim 1, wherein said countercoupling parts are provided with a permanent magnet.

6. A twisting device as defined in claim 1, wherein said countercoupling parts are provided with a magnet armature.

7. A twisting device as defined in claim 1; and further comprising holders which are clamped on said heddle supporting rails, said countercoupling parts are formed on said holders.

8. A twisting device as defined in claim 1, wherein at least one said coupling parts and said countercoupling parts is formed at least partially of a synthetic plastic body in which a magnetic part is embedded.

9. A twisting device as defined in claim 8, wherein said magnetic part embedded in said synthetic plastic body is formed as a magnet.

10. A twisting device as defined in claim 8, wherein said magnetic part embedded in said synthetic plastic body is formed as a magnet armature.

11. A twisting device as defined in claim 1, wherein said coupling part connected with said semi-heddle is formed as a sliding body which surrounds one of said lifting heddles.

12. A twisting device as defined in claim 11, wherein said coupling part connected with said semi-heddle is placed on both said lifting heddles.

13. A twisting device as defined in claim 11, wherein said coupling part connected with said semi-heddle is composed of two parts which are placed on said both lifting heddles and fixedly connected with one another.

14. A twisting device as defined in claim 1, wherein said coupling part operates as a magnet armature, said semi-heddle together with said coupling part being formed as a one-piece stamped part.

* * * * *